US008002240B1

(12) United States Patent
Wilson, Sr.

(10) Patent No.: US 8,002,240 B1
(45) Date of Patent: Aug. 23, 2011

(54) CONCRETE FRAME LIFTING DEVICE AND METHOD TO USE

(76) Inventor: Richard M. Wilson, Sr., Hartley, IA (US)

( * ) Notice: Subject to any disclaimer, the term of this patent is extended or adjusted under 35 U.S.C. 154(b) by 684 days.

(21) Appl. No.: 12/126,002

(22) Filed: May 23, 2008

(51) Int. Cl.
*B66F 13/00* (2006.01)

(52) U.S. Cl. ..... 254/1; 254/329; 254/334; 254/335; 254/336

(58) Field of Classification Search ..... 254/1, 329, 254/334, 335, 336
See application file for complete search history.

(56) References Cited

U.S. PATENT DOCUMENTS 4,795,136 A * 1/1989 Haefner ..... 254/336
* cited by examiner

*Primary Examiner* — Joseph J Hail
*Assistant Examiner* — Shantese McDonald
(74) *Attorney, Agent, or Firm* — Lawrence J. Gibney, Jr.

(57) ABSTRACT

This invention will assist or allow an operator to easily lift a concrete frame panel into position without much risk of personal injury and with greater efficiency of time. A lifting bar is secured to a vertical frame member through openings in the vertical frame members and a crane or forklift is used to lift the panel prior to setting it to form the wall.

9 Claims, 6 Drawing Sheets

CONCRETE FRAME LIFTING DEVICE AND METHOD TO USE

BACKGROUND OF THE INVENTION

A. Field of the Invention

This relates to the construction trade in general and specifically a device to assist in erecting frame members to construct a wall.

B. Prior Art

There are many other prior art references to framing devices. Representative examples of this type of structure, including making a cast panel that can be found at Manning, U.S. Pat. No. 5,976,442, and Parker, U.S. Pat. No. 6,625,937. Both the Manning and Parker are modular building methods of construction.

This device is used specifically with frame members to build a wall. Frame members are erected into a rectangular configuration and concrete is poured into the middle of the frame members to form the wall. This application addresses both the safety concerns to the workers when a wall is erected as well as achieving a significant cost savings because of the reduction in manpower that is required. None of the prior art achieves these results.

BRIEF SUMMARY OF THE INVENTION

This device will be used in the field of construction. particularly, commercial construction. It is often necessary to make or "form" concrete walls by erecting two similarly situated panels that are spaced a predetermined distance apart and closed at the respective ends. Concrete is then poured into the cavity and allowed to set or cure to form the wall. The panels are then removed for the formation of the next wall section.

The panels, however, are very heavy and are quite awkward and often dangerous to lift. Most of the panels are standard sizes and different-sized panels can be placed together to form different-sized walls. The panels are further comprised of a plurality of vertical frame members and horizontal frame members of a certain predetermined thickness. Openings are provided on the vertical frame members and enable the device to be lifted by a crane or forklift.

One side of the panel will be open to expose the vertical frame members and the other side is solid.

One of the difficulties or challenges arises when erecting the frame members to initially form the wall structure. A greater challenge is posed when the frame members must be stacked on top of each other which is sometimes required to erect a higher wall. When a higher wall is to be erected, the frame members must be stacked one frame member on top of the other.

Each frame member has various horizontal and vertical members with an opening on the vertical as well as the horizontal members. These openings allow a lifting mechanism with a piece of channel to be placed inside the opening and secured with a pin or spike. This enables a crane to lift the entire panel to form the wall. The device can then simply be dismantled after use.

This device eliminates the risks of endangering humans when lifting these panels and reduces the amount of manpower that is required to lift and position the panels.

The device will be comprised of a lifting bar on which will be placed two members that slide along the length of the tube or bar. Stop mechanisms will be placed on either end of the bar or tube to prevent the sliding pieces from inadvertently slipping off the bar.

On the bottom of the sliding member will be a piece of channel in the general shape of an "L." The "L" member will have an opening in the middle, and the opening in the "L" is placed through the opening of the vertical frame members. Once the lifting bar is secured to the panel a forklift or crane is attached to the lifting bar.

The panels are lifted safely by the crane or forklift. Although some human intervention is necessary, the amount required is greatly reduced. This device results in cost savings, but will more importantly reduce the risk of human injury.

DRAWING REFERENCE NUMBERS

| | |
|---|---|
| 1 | Concrete |
| 5 | Device |
| 6 | Second Bar |
| 7 | Connection Means |
| 8 | Lifting Bar |
| 9 | Slide Mechanism |
| 10 | Panel |
| 11 | L member |
| 12 | Stop Mechanism |
| 13 | Means to Secure the Lifting Mechanism to the Frame |
| 14 | Lifting Loop |
| 15 | Vertical Frame Member Opening |
| 18 | L member opening |
| 19 | Horizontal Frame Members |
| 20 | Vertical Frame Members |
| 21 | Solid Side |

DETAILED DESCRIPTION OF THE EMBODIMENTS

Figure 8:
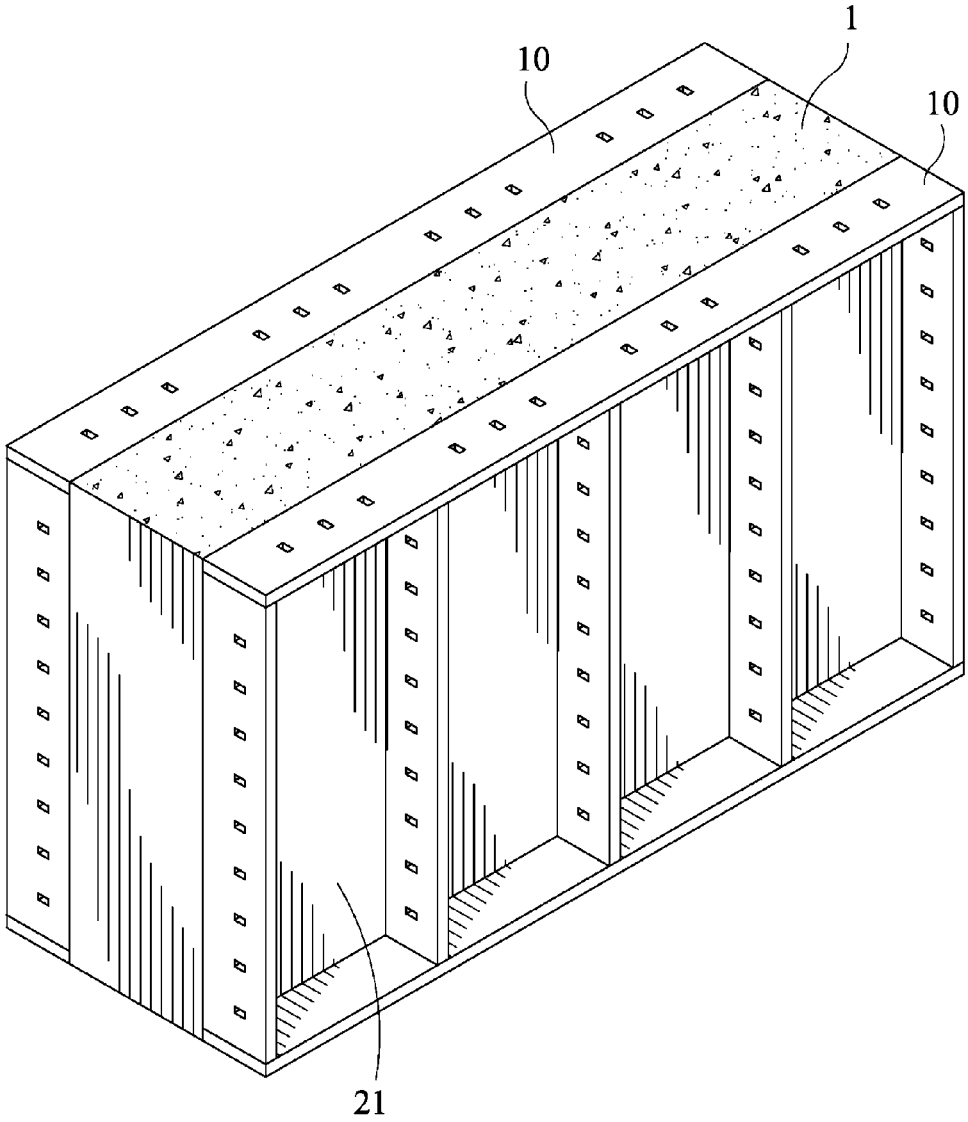
FIG. 8 is a view of the concrete between the frame members.

It is important sometimes in erecting walls to place identical frame members or panels a predetermined distance apart in order to pour concrete to form a wall. The identical frame members essentially come in a rectangular shape although the shapes may come in different sizes and dimensions. The purpose of the panels 10 is to enable the worker to pour a large amount of concrete 1 in-between two identical frame members to form a wall such as depicted in FIG. 8.

The panels 10 that are used to form a wall are oftentimes very heavy and difficult to maneuver. The panels 10 will be comprised of a series of vertical frame members 20 as well as horizontal members 19. Openings 15 are provided on the vertical frame members 20. Because the panels are used in the construction trades, they are likely to be constructed from steel or other strong durable material.

Figure 1:
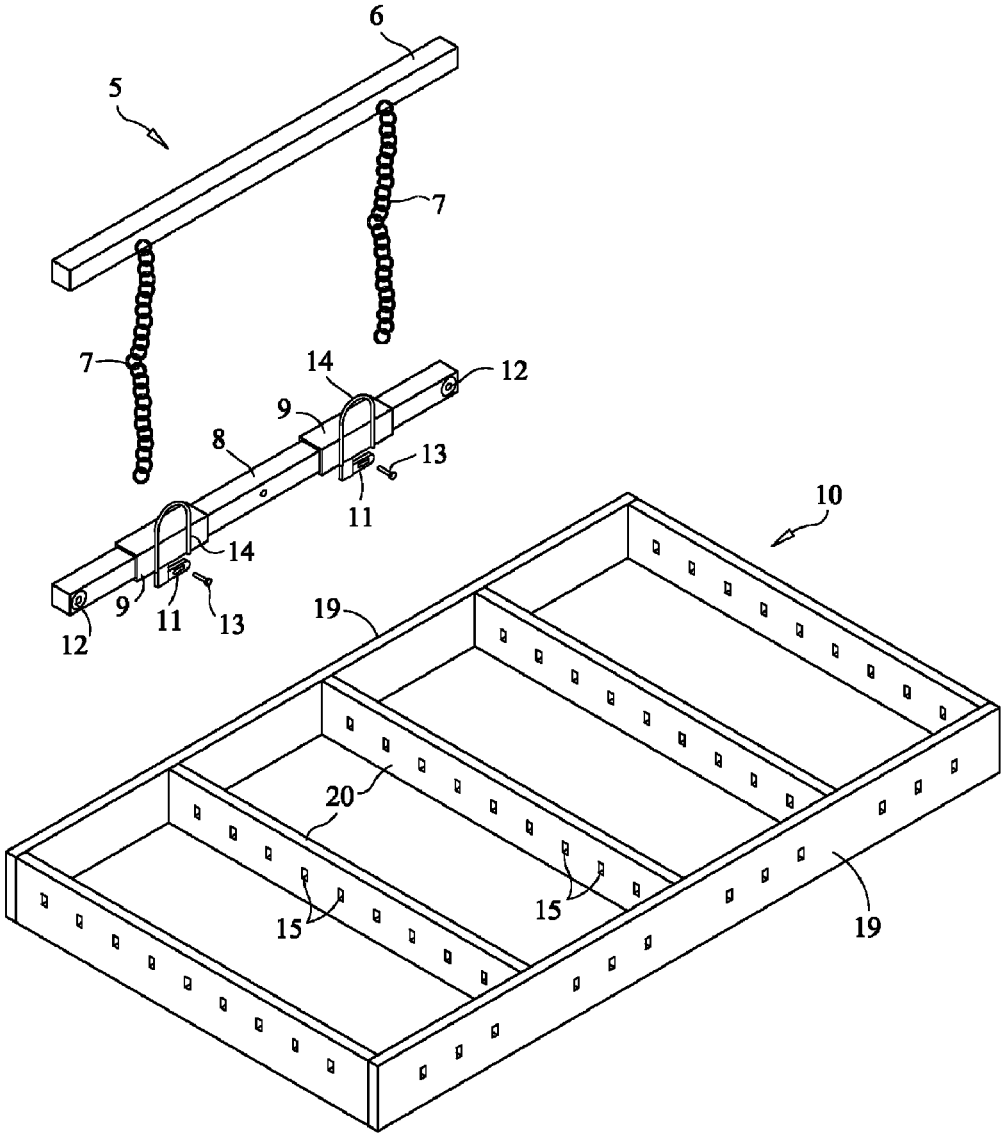
FIG. 1 is an isometric view of the various parts to this device.

The vertical and horizontal members form the essential structure of the panel 10. Two horizontal frame members 19 of predetermined thickness, width and length will form the top and bottom sides of the panel 10; the other two sides will be formed by two vertical frame members 20. When the horizontal frame members are secured to the vertical frame members in this fashion a rectangular shape is created such as depicted in FIG. 1.

Interior to the outer edges of the panel 10 are a plurality of vertical frame members 20 that are placed between the horizontal frame members and extend the entire length of the panel. Openings 15 are provided in the vertical frame members.

One side of the panel 10 is open to expose the vertical frame members 20 and the other side is closed or solid 21 to contain the concrete as it is poured such as depicted in FIG. 8. In the middle between the outer edges of the panel, a plurality of vertical members are interspaced between the bottom and top horizontal members to form the panel 10.

When this device is used, a lifting bar 8 will be used to lift and position the panel 10. The lifting bar 8 is also constructed from a strong metal and steel is probably a preferred choice.

Figure 5:
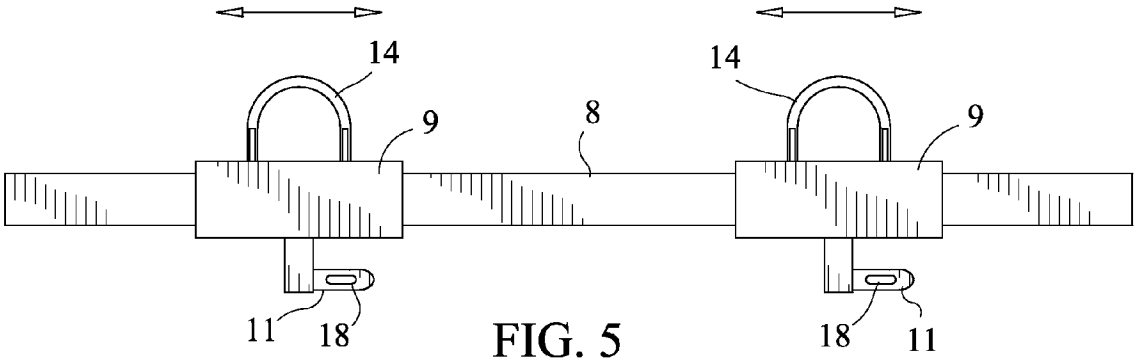
FIG. 5 is a back view of the bar.
Figure 6:
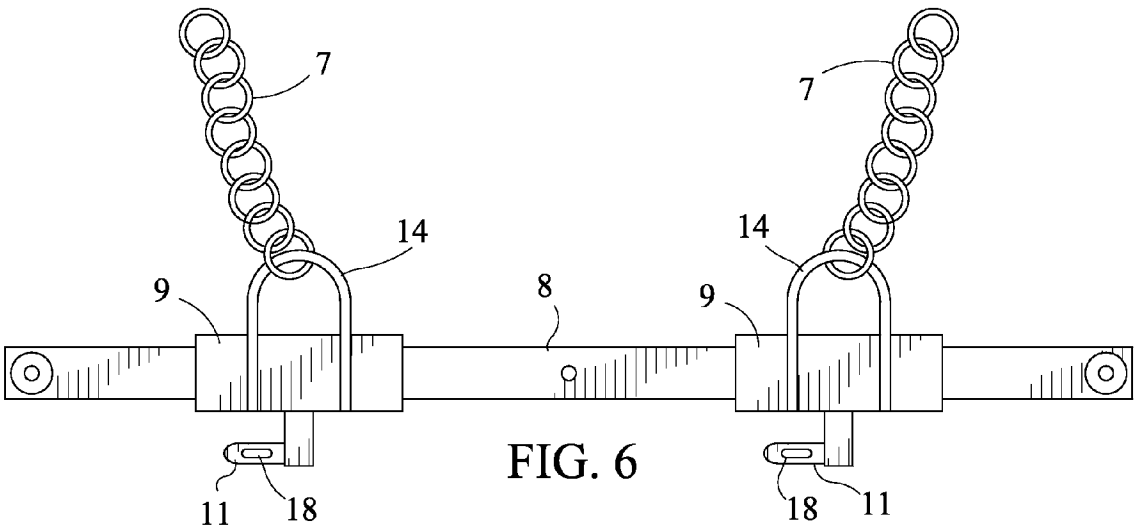
FIG. 6 is a front view of the bar with the attached lifting means.
Figure 7:
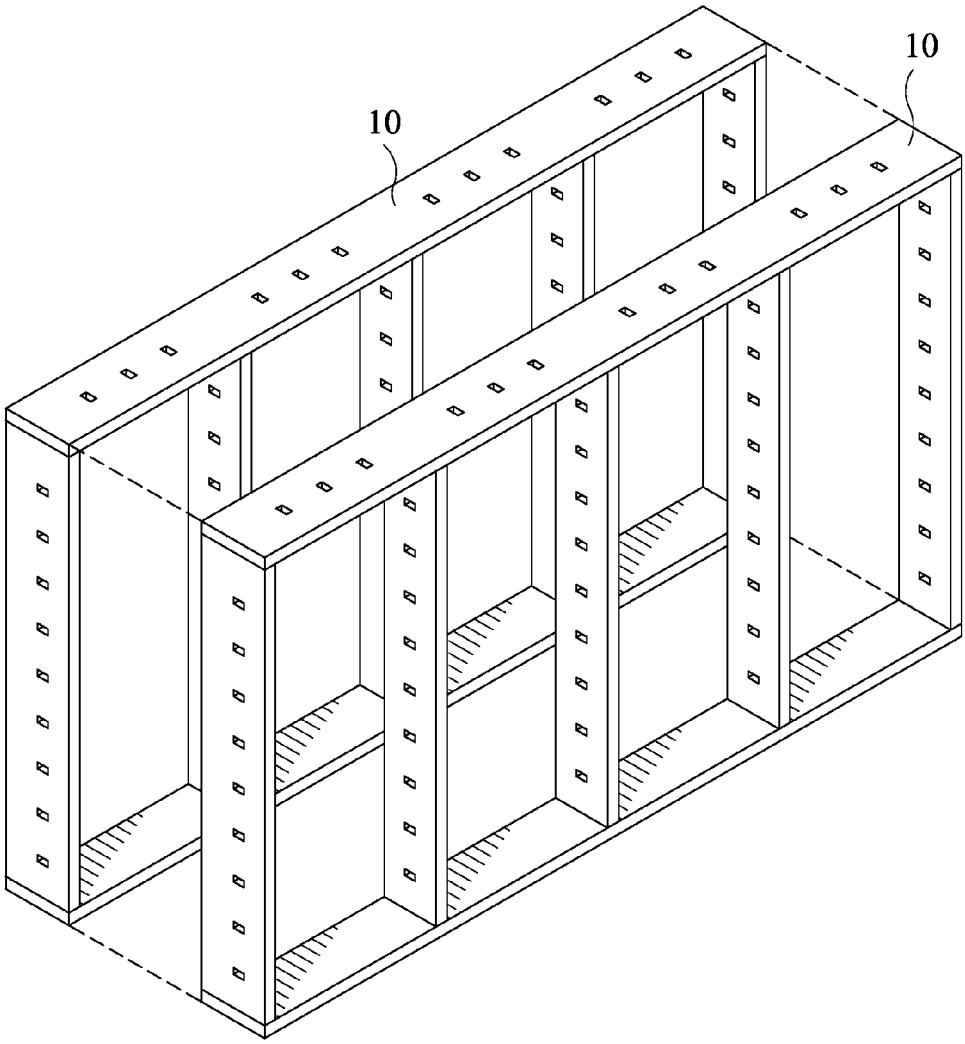
FIG. 7 is an isometric view of the two frame members prior to pouring into concrete without depicting the solid side.

On the lifting bar 8 will be two slide members 9 that will be allowed to move along the lifting bar. On a portion of the slide member 9 will be a piece of channel or "L" shaped member 11 with an opening 18 in the center of the "L" shaped member such as depicted in FIGS. 5 and 6. A lifting loop 14 is attached to the slide member 9.

A portion of the "L" member 11 will be placed through the opening 15 of the vertical frame member 20 so that the opening 18 protrudes on the opposite side of the vertical frame member 20. The L member is secured in place by putting a spike, pin, tapered pin, nail or other type of connection means 13 through the opening 18 in the L member 11.

In order to insure that the sliding members 9 do not accidentally or inadvertently fall off the lifting bar 8, a pair of stop mechanisms 12 will be provided near the ends of the lifting bar 8. The stop mechanism 12 may be a raised protrusion or may be made as part of the lifting bar 8 but regardless extend a predetermined distance away from the outer surface to prevent the sliding mechanism 9 from falling off the lifting bar 8.

When the lifting bar 8 is to be attached to the panel 10, the panel 10 is positioned such that the worker can reach the exposed vertical frame members 20. The panel may be laid flat or may be laid at an angle but regardless of the position the worker must be able to reach the exposed vertical frame members.

The lifting bar 8 is then placed on a portion of the exposed panel and the sliding mechanisms 9 are positioned so that the L shaped member 11 is aligned with a predetermined opening on the vertical frame member 20. The L shaped member 11 is then slid through the opening in the vertical frame member 15 so that a portion of the L shaped member opening 18 protrudes from the other side of the vertical frame member.

The means to secure 13 the L shaped member is then placed through the opening 18. The means to lift the lifting bar 7 is then attached to the lifting loop 14 on the sliding mechanism 9 such as depicted in FIG. 6.

Figure 2:
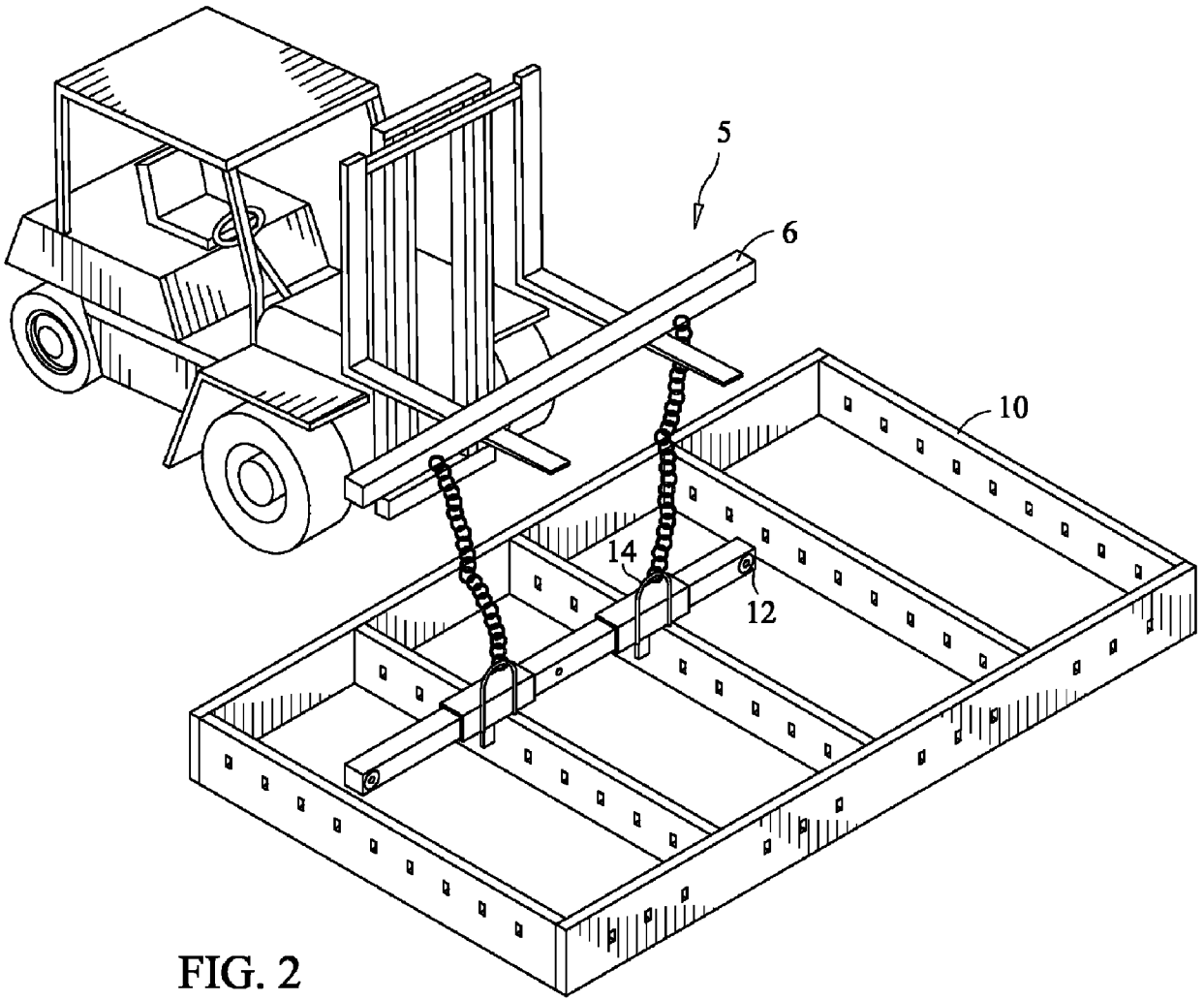
FIG. 2 is a view of the device with a bar and hoisting mechanism attached to a frame member and attached to a forklift.
Figure 3:
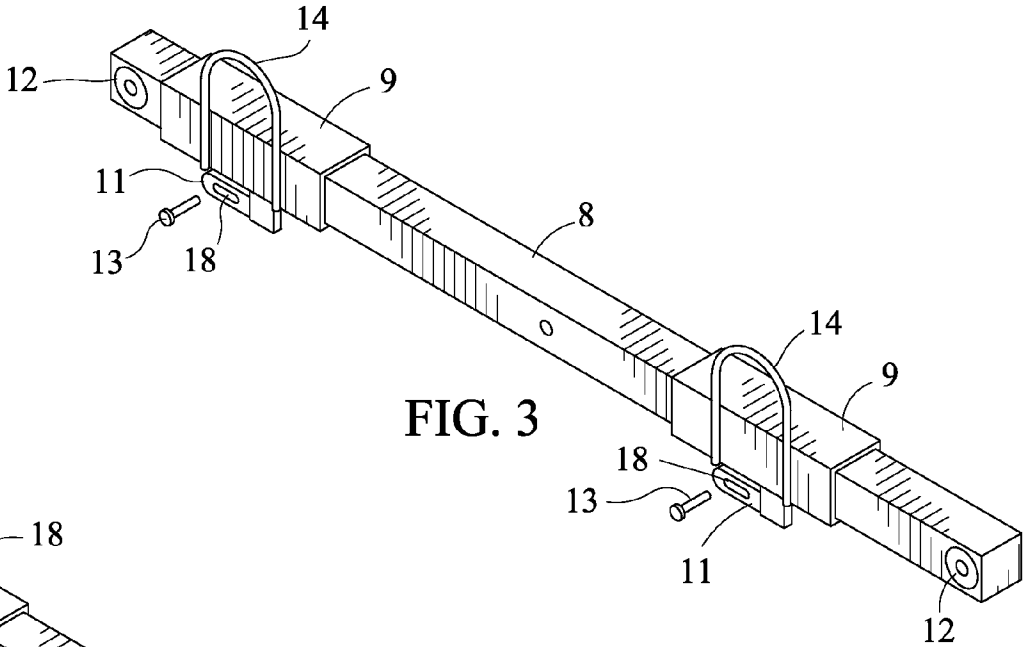
FIG. 3 is an isometric front view of the bar.
Figure 4:
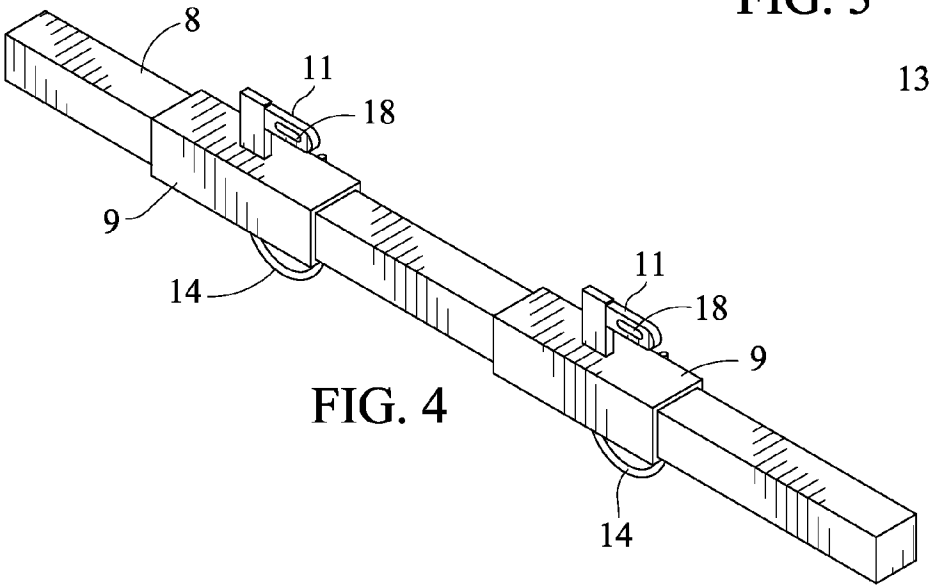
FIG. 4 is an isometric back view of the bar.

Once the lifting bar 8 is secured to the vertical frame member 20 of the panel, the lifting bar 8 is secured to the lifting device which may be a crane or forklift such as depicted in FIG. 2. Chains, ropes or cables 7 may be used to secure the lifting bar to the lifting device by attaching one end of the chain, rope or cable to the lifting loop 14 on the lifting bar. A second bar 6 may also be used by the lifting device to lift the panel.

The inventor claims:

1. A concrete frame-lifting device, which is comprised of:
a plurality of panels;
wherein each of the panels have a predetermined shape;
wherein each of the panels has a first side and a second side;
said first side of each of the panels is open;
said second side of each of the panels is solid;
wherein each of the panels are comprised of vertical and horizontal frame members;
wherein two horizontal frame members are provided;
said horizontal frame members are of predetermined thickness, width and length;
wherein the vertical frame members extend between the horizontal frame members;
wherein a plurality of openings are provided in the vertical frame members;
a lifting bar, having a predetermined shape
a sliding mechanism placed over the lifting bar;
wherein the sliding mechanism is allowed to slide over the lifting bar;
a piece of L shaped channel positioned on one end of the sliding mechanism;
wherein an opening is provided in the L shaped channel;
wherein a lifting loop is provided on the sliding member;
stop mechanisms placed on the lifting bar;
said stop mechanisms prevent the sliding mechanisms from sliding off the lifting bar;
a means to secure the lifting bar to the vertical frame member;
wherein the means to secure the lifting bar to the vertical frame member is placed in the opening of the L member;
a means to lift the lifting bar;
means to connect the lifting bar to the means to lift.

2. The device as described in claim 1 wherein the means to secure the lifting bar to the vertical frame member is a spike.

3. The device as described in claim 1 wherein the means to secure the lifting bar to the vertical frame member is a screw.

4. The device as described in claim 1 wherein the means to secure the lifting bar to the vertical frame member is a tapered pin.

5. The device as described in claim 1 wherein the means to lift is a forklift.

6. The device as described in claim 1 wherein the means to lift is a crane.

7. The device as described in claim 1 wherein the means to connect the lifting bar to the means to lift is a plurality of cables.

8. The device as described in claim 1 wherein the means to connect the lifting bar to the means to lift is a plurality of ropes.

9. The device as described in claim 1 wherein the means to connect the lifting bar to the means to lift is a plurality of chains.

* * * * *